US005782380A

United States Patent [19]

DiSanto

[11] Patent Number: 5,782,380

[45] Date of Patent: Jul. 21, 1998

[54] WATER DISPENSING SYSTEM

[75] Inventor: Timothy J. DiSanto, Modesto, Calif.

[73] Assignee: Pure Fill Corporation, Modesto, Calif.

[21] Appl. No.: 722,610

[22] Filed: Sep. 27, 1996

[51] Int. Cl.[6] ..... B67D 5/10

[52] U.S. Cl. ..... 222/2; 222/111; 222/129; 141/369; 312/136

[58] Field of Search ..... 141/369; 312/114, 312/128, 136, 138.1, 327, 313; 222/2, 109, 111, 129.1, 182, 129

[56] References Cited

U.S. PATENT DOCUMENTS

| | | | |
|---|---|---|---|
| D. 182,277 | 3/1958 | Giepen . | |
| D. 197,482 | 2/1964 | Boldt et al. . | |
| D. 207,791 | 5/1967 | Stein . | |
| D. 209,084 | 10/1967 | Moore . | |
| D. 222,704 | 12/1971 | Winsett . | |
| D. 235,388 | 6/1975 | Taylor . | |
| D. 245,608 | 8/1977 | Murphy . | |
| D. 250,536 | 12/1978 | Bourke . | |
| D. 262,030 | 11/1981 | Reece . | |
| D. 271,496 | 11/1983 | Lents . | |
| D. 282,084 | 1/1986 | Koch . | |
| D. 283,827 | 5/1986 | Albright . | |
| D. 291,896 | 9/1987 | Stover . | |
| D. 294,105 | 2/1988 | Mathews . | |
| D. 294,271 | 2/1988 | Glaser . | |
| D. 296,449 | 6/1988 | Lovbrand . | |
| D. 304,407 | 11/1989 | Fossella . | |
| D. 313,331 | 1/1991 | Schroeder et al. . | |
| D. 324,464 | 3/1992 | Credle, Jr. et al. . | |
| D. 343,332 | 1/1994 | Schroeder et al. . | |
| D. 361,239 | 8/1995 | DiSanto . | |
| D. 364,771 | 12/1995 | DiSanto . | |
| 449,024 | 3/1891 | Allin | 222/2 X |
| 494,061 | 3/1893 | Day . | |
| 1,026,635 | 5/1912 | Tomlinson . | |
| 1,300,285 | 4/1919 | McDonald . | |
| 1,655,090 | 1/1928 | Cunningham . | |
| 1,702,560 | 2/1929 | Ebinger . | |
| 1,706,213 | 3/1929 | Cordley . | |
| 2,043,856 | 6/1936 | Knapp . | |
| 2,307,589 | 1/1943 | Johnson | 222/2 X |
| 2,362,104 | 11/1944 | Smith . | |
| 2,583,461 | 1/1952 | Arnett . | |
| 2,668,636 | 2/1954 | Martin | 222/2 |
| 2,735,583 | 2/1956 | Misch . | |
| 2,754,998 | 7/1956 | Doepke et al. . | |
| 2,774,393 | 12/1956 | Swan . | |
| 2,831,609 | 4/1958 | Montbriand et al. . | |
| 3,015,415 | 1/1962 | Marsh et al. | 222/144 X |
| 3,021,685 | 2/1962 | Gore et al. | 222/2 X |
| 3,185,348 | 5/1965 | Pollak et al. | 222/129.9 X |
| 3,207,282 | 9/1965 | Norris, Jr. . | |
| 3,221,859 | 12/1965 | McAbee | 222/2 X |
| 3,311,992 | 4/1967 | Seley | 312/114 X |
| 3,375,913 | 4/1968 | Norris, Jr. . | |
| 3,382,897 | 5/1968 | Skiera et al. . | |
| 3,665,736 | 5/1972 | Wilson . | |
| 3,856,676 | 12/1974 | Grimme, Jr. et al. . | |
| 3,930,698 | 1/1976 | Colgan . | |
| 3,951,303 | 4/1976 | Hobden et al. . | |
| 4,160,727 | 7/1979 | Harris Jr. . | |
| 4,174,872 | 11/1979 | Fessler . | |
| 4,235,352 | 11/1980 | Newman et al. . | |
| 4,316,557 | 2/1982 | Benoun et al. . | |
| 4,501,381 | 2/1985 | Hart . | |
| 4,528,093 | 7/1985 | Winer . | |
| 4,585,554 | 4/1986 | Burrows . | |

(List continued on next page.)

OTHER PUBLICATIONS

Redee Cup Advertising, Vending Times, D7/308, p. 31, Jul. 1984.

*Primary Examiner*—Kenneth Bomberg
*Attorney, Agent, or Firm*—Michael D. Rechtin

[57] ABSTRACT

A water dispenser comprising a plurality of water filling stations located side by side in a single sink. Each station includes an intermediate shelf. A filling station is coupled to each of the stations and selectively provides one of a plurality of predetermined water volumes with a single actuation.

6 Claims, 5 Drawing Sheets

U.S. PATENT DOCUMENTS 4,597,509 7/1986 Pereira .
4,623,467 11/1986 Hamlin .
4,651,862 3/1987 Greenfield, Jr. ..... 222/2 X
4,658,872 4/1987 Ellis .
4,801,375 1/1989 Padilla .
4,842,723 6/1989 Parks et al. .
4,946,599 8/1990 Craig .
4,958,747 9/1990 Sheets .
4,969,991 11/1990 Valadez .
5,064,097 11/1991 Brog et al. .
5,072,590 12/1991 Burrows .
5,108,590 4/1992 DiSanto .
5,112,477 5/1992 Hamlin .
5,147,532 9/1992 Leek Jr. .
5,152,429 10/1992 Billings .
5,184,476 2/1993 Desrosiers et al. .
5,192,004 3/1993 Burrows .
5,213,597 5/1993 Campbell .
5,246,141 9/1993 Burrows .
5,373,874 12/1994 Shieh ..... 222/129.1 X
5,492,250 2/1996 Sardynski ..... 222/129.1 X
5,507,329 4/1996 Shub ..... 222/129.1 X
5,582,717 12/1996 DiSanto ..... 222/2 X

WATER DISPENSING SYSTEM

BACKGROUND OF THE INVENTION

The present invention relates generally to water dispensers. More particularly, the present invention relates to dispensing purified water with a compact, easy to use coin-operated machine.

Many grocery stores feature coin operated vending machines which dispense purified drinking water. The customers bring a bottle to the machine, place it in the vending station, and then insert coins into the machine to actuate the water dispenser. The machine then dispenses a single predetermined quantity of water which may not fill the bottle. Generally, these water dispensers fill one container at a time. If more than one station is required, the service provider must supply expensive additional machines, and surrender additional space to water dispensing services. Therefore, the cost of providing this service is increased significantly. Although some prior art devices contain multiple filling stations, these are much larger than single water dispensing units, and therefore also require a great deal of space.

It is therefore an object of the present invention to provide a self service water dispenser which efficiently utilizes space.

It is a further object of the invention to provide a self service water dispenser that dispenses a plurality of water volumes upon actuation of a single button, lever or similar device.

It is a still further object of the invention to provide a self service water dispenser that provides a plurality of filling stations in a compact and attractive configuration.

Other advantages and features of the invention, together with the organization and manner of operation thereof, will become apparent from the following detailed description when taken in conjunction with the accompanying drawings, wherein like elements have like numerals throughout the drawings.

DETAILED DESCRIPTION OF PREFERRED EMBODIMENTS

Figure 1:
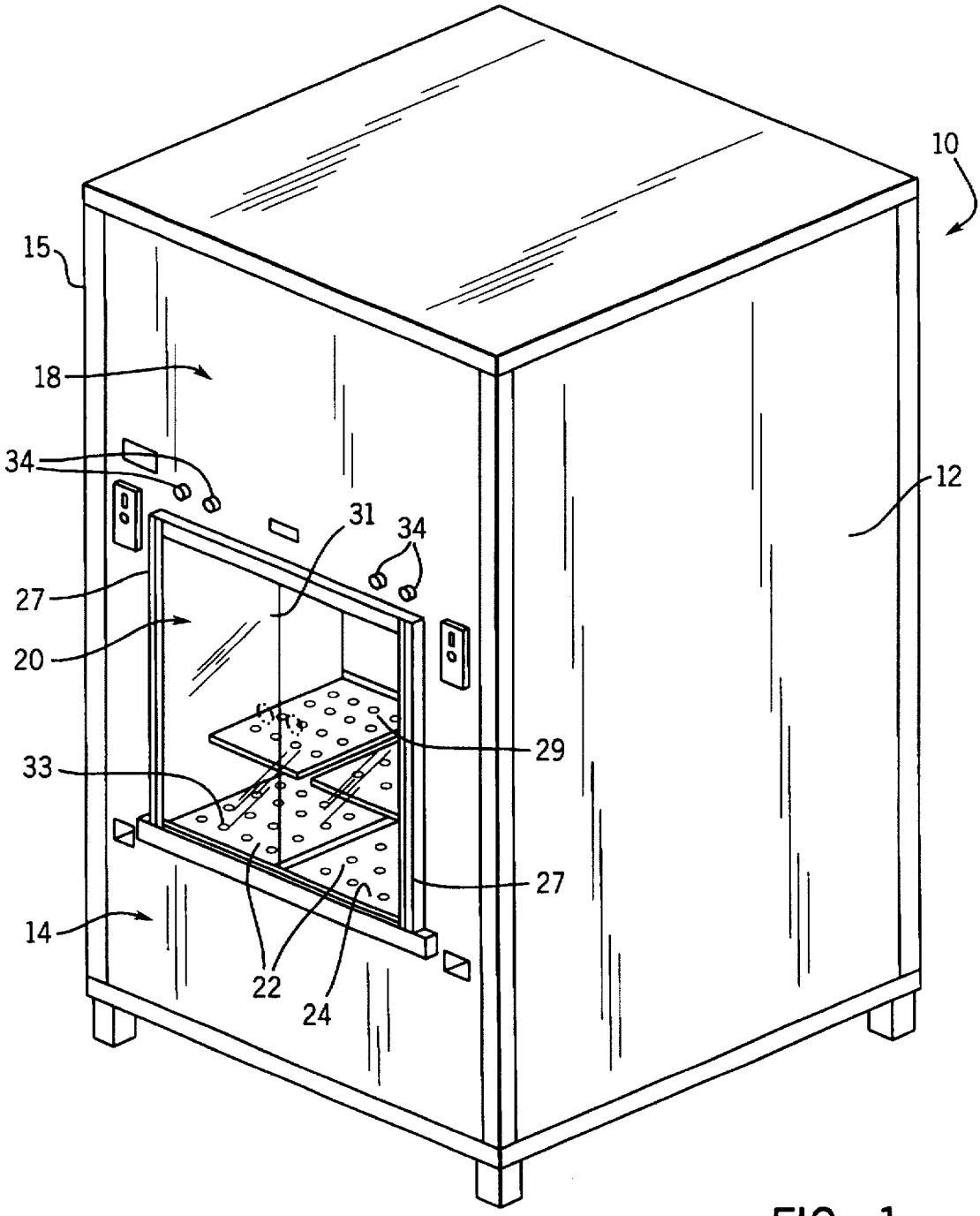
FIG. 1 illustrates a perspective view of a water dispenser constructed in accordance with one form of the invention.
Figure 2:
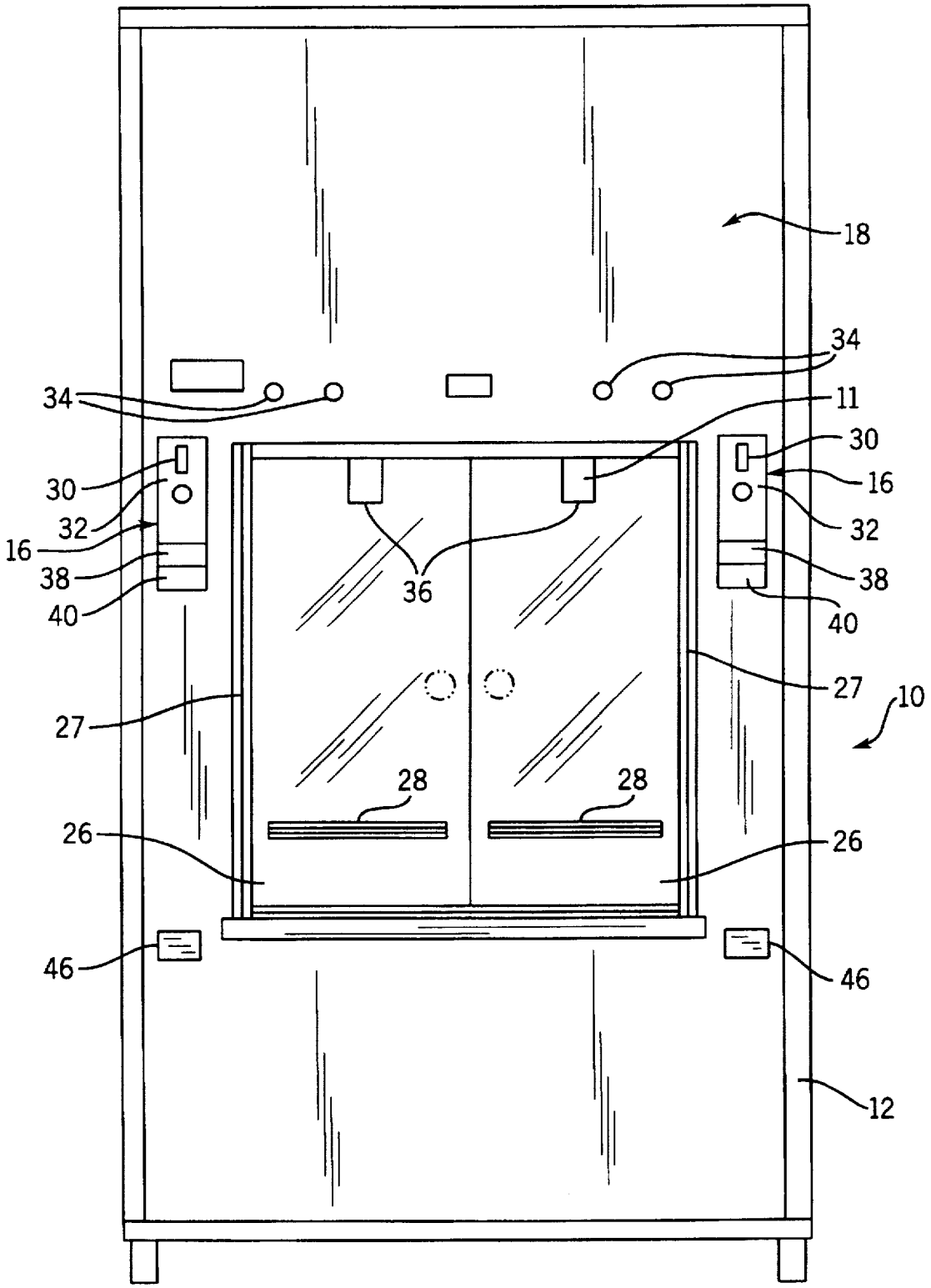
FIG. 2 shows a front view of the water dispenser shown in FIG. 1.
Figure 3:
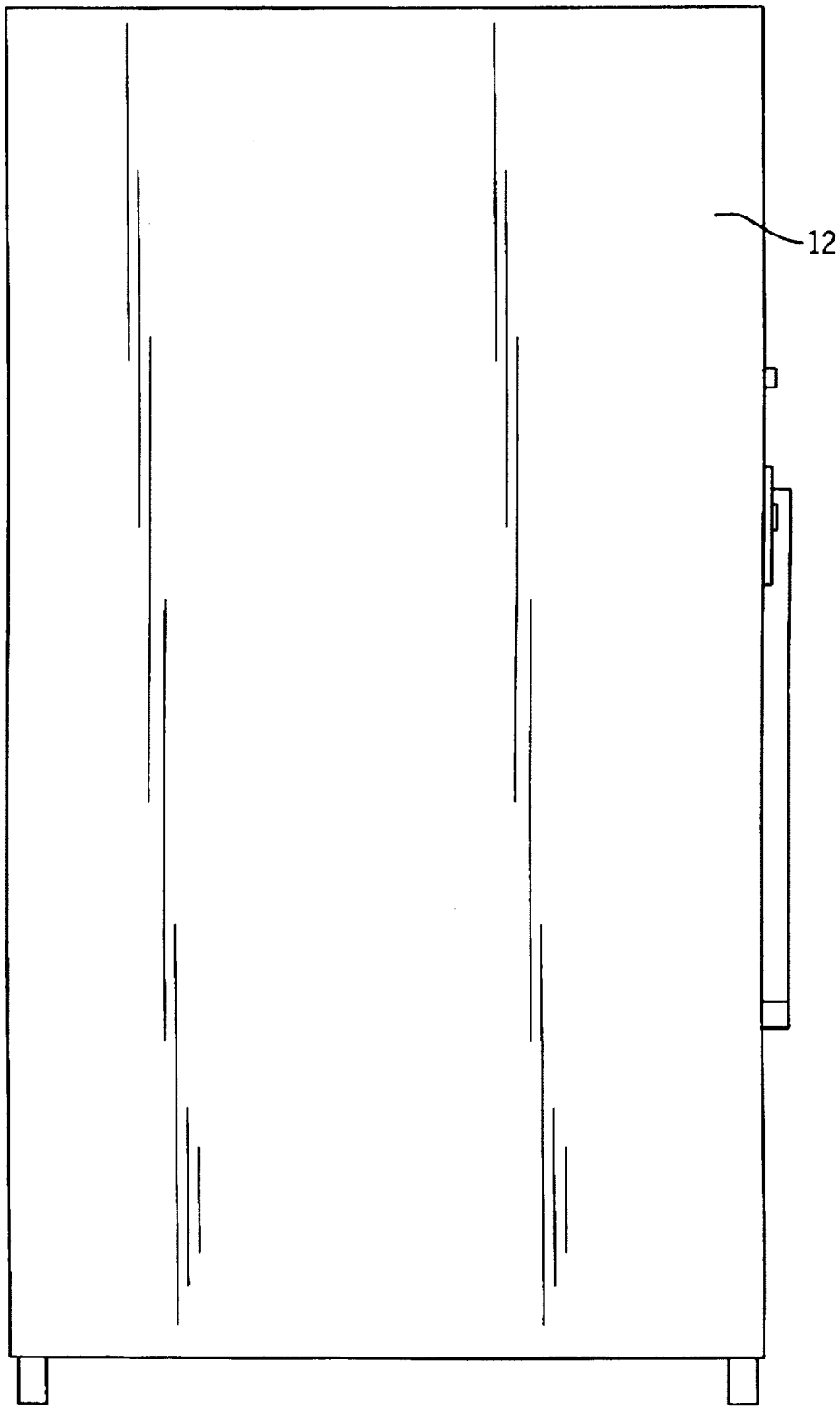
FIG. 3 illustrates a side view of the water dispenser shown in FIGS. 1 and 2.
Figure 4:
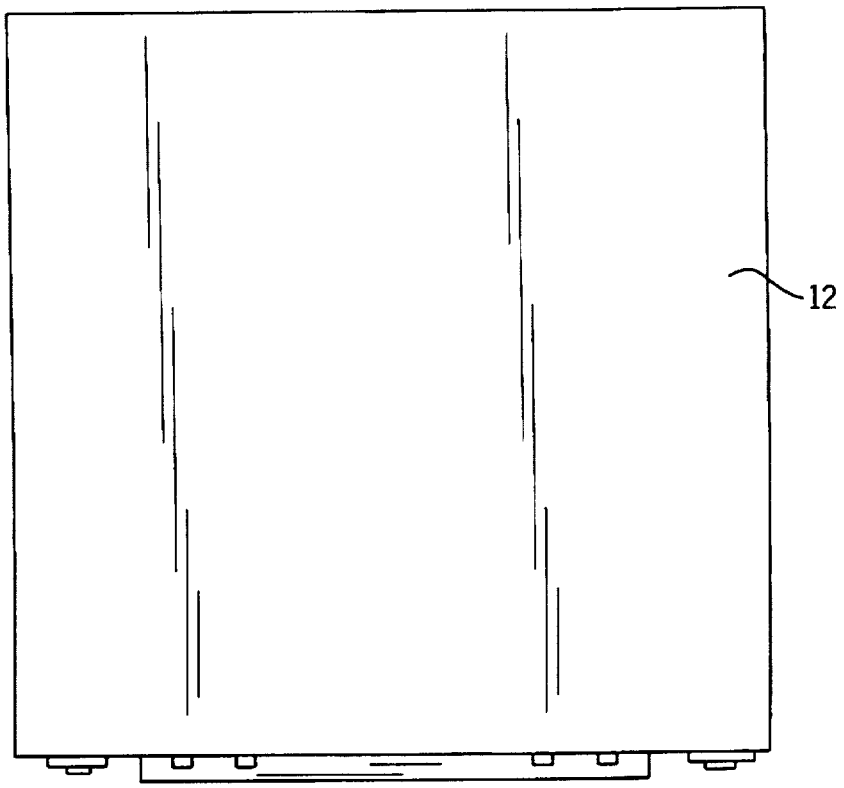
FIG. 4 shows a top view of the water dispenser shown in FIGS. 1–3.
Figure 5:
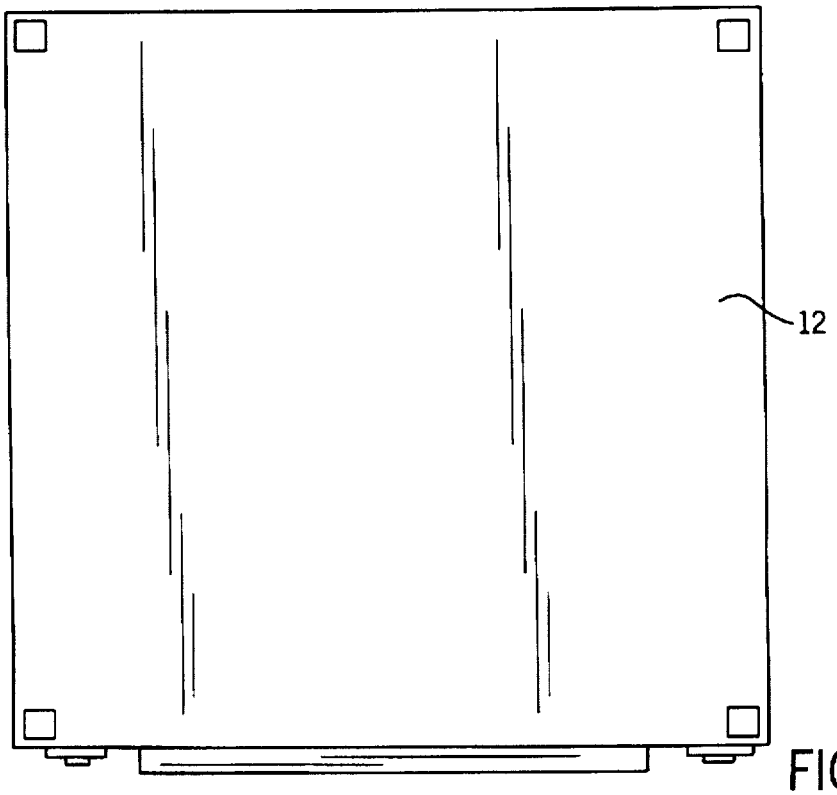
FIG. 5 illustrates a bottom view of the water dispenser shown in FIGS. 1–4.
Figure 6:
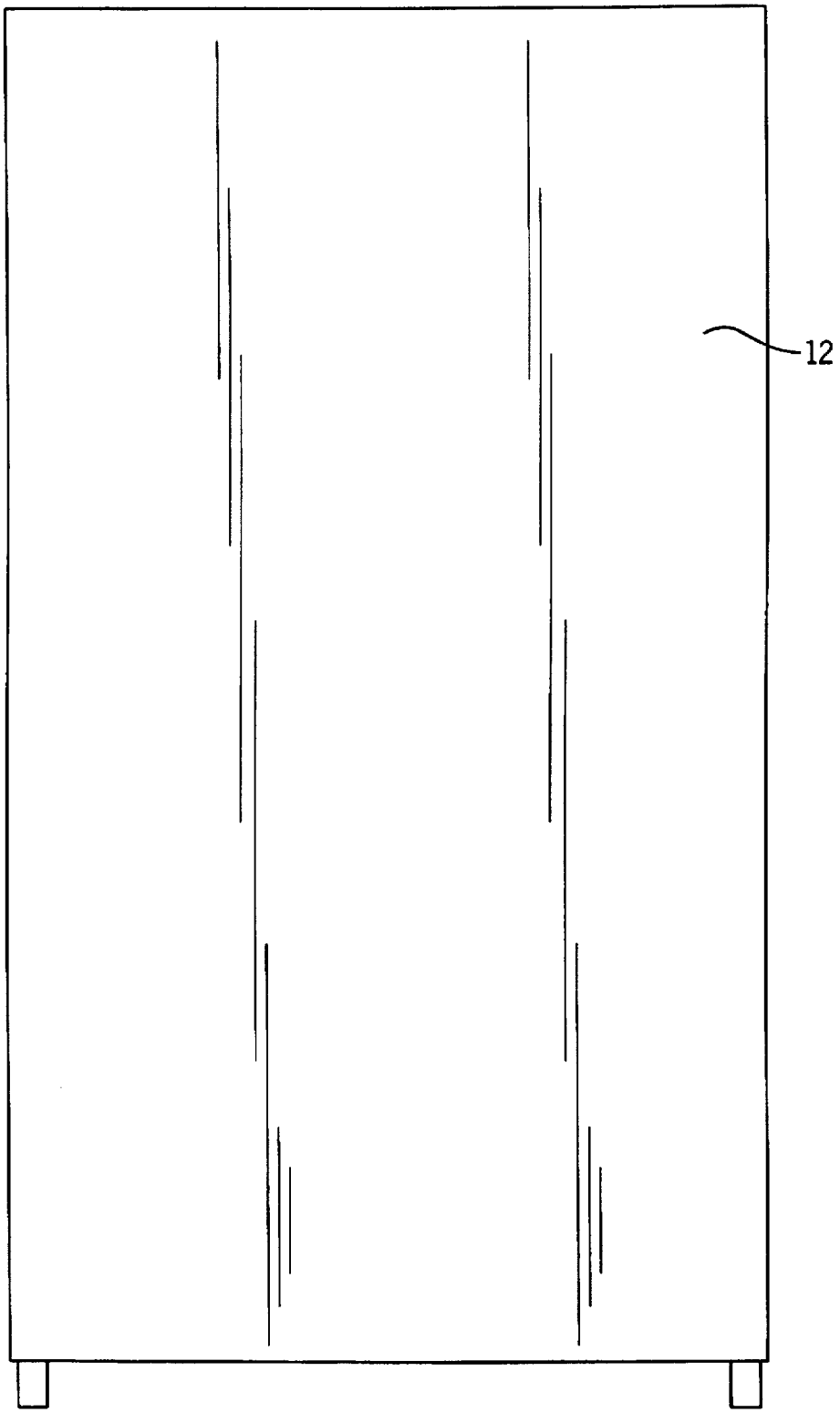
FIG. 6 shows a back view of the water dispenser shown in FIGS. 1–5.

Referring to the Figures, and more particularly to FIG. 1, a water dispenser constructed in accordance with one preferred embodiment of the invention is shown at 10. While a variety of products can be dispensed in accordance with the invention, preferably water is dispensed as described herein. The water dispenser 10 preferably comprises a cabinet 12 for housing a water supply and filtration system 11. The cabinet 12 further comprises a cabinet panel 14 having a hinge 15. The cabinet panel 14 includes a coin operation system 16, at least one display area 18, and an aperture 20 in the cabinet panel 14 which provides access to a plurality of filling stations 22.

The water supply and filtration system 11 is operated using coin operation system 16, which is coupled to the cabinet 12 in a conventional manner. The filling stations 22 are preferably located side by side inside the aperture 20 above a single sink 24. Because all filling stations 22 can use the same sink 24, the water dispenser 10 can be constructed in the same cabinet as a single water dispenser system, thereby reducing manufacturing costs and required floor space.

Access to the filling stations 22 is provided by at least one pivotable door 26 connected to the cabinet 12 by a hinge 27 along a centerline 31 located near and preferably covering the aperture 20. When the pivotable door 26 is opened, the user gains access to an intermediate shelf 28 having a hinge 29. The intermediate shelf 28 provides a location at which the user can place a relatively small empty container to be filled. Alternatively, the intermediate shelf 28 can be pivoted or otherwise conventionally moved out of the way to enable placement and filling of a larger container that stands on the bottom 33 of the aperture 20.

To fill the container, the user must insert money into the coin operation system 16. This money can be put in either the coin input slot 30 or the dollar input slot 32, which accepts paper money. After payment has been made, the user selects the amount of water to be dispensed preferably by pushing one of a plurality of actuating devices such as buttons 34 for actuating dispensing of a like plurality of volumes of water. The buttons 34 are located above the aperture 20 and the pivotable access doors 26. While two buttons 34 are shown for each filling station 22, it is understood that any plurality of fill select buttons 34 can be used. Alternatively, a single button 34 or other actuating device can be used in conjunction with a dial or other device to select and dispense the desired volume of water.

When the button 34 is selected, the water dispenser 10 actuates a filling apparatus 36 in fluid communication with the water supply and filtration system 11. The filling apparatus 36 is located above the intermediate shelf 28 and begins the dispensation of water after the filling apparatus 36 is actuated. The amount of water dispensed is determined by which button 34 is selected. When the predetermined amount of water has been dispensed, the water dispenser 10 deactivates the filling apparatus 36 in a conventional manner. The user can then remove the container from the filling station 22. If the user has inserted more money than required, a coin return system 38 activates an electronic solenoid 40 to return the correct change. The electronic solenoid 40 minimizes the size of the coin operation system 16 so it is possible to install one coin operation system 16 for each filling station 22.

The layout of the cabinet 12 is critical to the water dispensing business. If the cabinet is not laid out in an attractive and easy to use configuration, sales will be lost. Because water containers are heavy when filled, the aperture 20 is preferably located at a height convenient for loading and unloading heavy objects. The aperture 20 is preferably sized to allow easy insertion of containers that can hold up to about five gallons of water.

The display area 18 is preferably dimensioned large enough to be readily seen from fifty feet or more away to draw customers to the dispenser 10. The inventor has found that dimensioning the cabinet 12 such that its height (without legs) is about 1.75 to 2 times its width, and the aperture 20 is square or slightly taller than it is wide provides a useful configuration. Further, locating the center of the aperture 20 at or preferably below the center of the cabinet 12 facilitates unloading heavy containers while providing a larger display area 18. Additionally, the coin operation systems 16 are preferably mounted substantially horizontally adjacent to and on opposing sides of the aperture 20. However, standard coin operation systems do not work in this configuration. Accordingly, in accordance with one preferred embodiment of the invention, the coin operation system 16 is electronically assisted. This electronic assistance can be provided in a number of ways, but preferably an electronic solenoid is used to actuate the coin basis. This allows the coin operation system to be mounted in a vertical configuration, enabling coin return apertures 46 to be located substantially vertically under the rest of the coin operation system.

In accordance with a method of use of the invention, the user opens one or more of the suitable access doors 26 and places one or more containers in the aperture 20. Next the user inserts coins or paper money into the coin operation system 38. This enables the water filling station 22 to dispense water when a button 34 is depressed.

While preferred embodiments have been illustrated and described, it should be understood that changes and modifications can be made thereto without departing from the invention in its broader aspects. Various features of the invention are defined in the following claims.

I claim:

1. A water dispensing system, comprising:

a cabinet having an aperture on a front side of said cabinet, said aperture leading to an interior space having a bottom surface, side walls and a top surface;

a plurality of water filling stations disposed within said aperture in the interior space and said stations located in one sink area of the interior space;

a plurality of shelves disposed on at least one of said side walls of said interior space, each of said shelves being hinged allowing independent positioning to support a plurality of containers of different sizes to receive water and also allowing independent positioning to enable a larger container having a bottom to be supported below said shelf;

a plurality of independently pivotable doors enabling access to said aperture with one of said plurality of said pivotable doors positioned in front of and associated with each of said water filling stations, thereby enabling access to each of said stations using an associated one of said pivotable doors;

a filling apparatus associated with each of said water filling stations for providing a volume of water, and a system for receiving payment and including at least one button which after payment is made can be activated to cause dispensing of the volume of water.

2. The water dispenser system as defined in claim 1 wherein said pivotable doors are hinged.

3. The water dispenser system as defined in claim 1 wherein said system for receiving payment comprises a coin slot for each of said stations.

4. The water dispensing system as defined in claim 3 wherein said at least one button comprises a button for each of said coin slots.

5. The water dispenser system as defined in claim 1 further including legs for supporting said cabinet.

6. A water dispenser system, comprising:

a plurality of water filling stations, each of said stations being located side by side in a single sink with an independent shelf positioned at each of said water filling stations, each said shelf independently hinged to allow supporting a small container to be filled or pivoted to enable positioning a larger container in each station; and a filling apparatus associated with each of said stations and for selectively providing a predetermined water volume upon actuation.

* * * * *